United States Patent [19]

Gasper

[11] 4,256,244

[45] Mar. 17, 1981

[54] CLIP-ON BALL HOLDER

[76] Inventor: Ronald S. Gasper, 8701 Eaglebrook Ct., Alexandria, Va. 22308

[21] Appl. No.: 148,149

[22] Filed: May 9, 1980

[51] Int. Cl.[3] ..... A41F 9/00

[52] U.S. Cl. ..... 224/252; 224/45 L; 224/919; 206/315 B

[58] Field of Search ..... 224/252, 45 L, 248, 224/269, 919; 206/315 B

[56] References Cited

U.S. PATENT DOCUMENTS

| | | | |
|---|---|---|---|
| 1,911,256 | 5/1933 | Andrew | 224/919 X |
| 2,074,180 | 3/1937 | Hatley | 224/919 X |
| 2,665,830 | 1/1954 | Fowler | 224/919 X |
| 3,768,709 | 10/1973 | Kinard | 224/919 X |
| 3,873,009 | 3/1975 | Goudreau | 224/919 X |
| 4,062,482 | 12/1977 | Szalony | 224/919 X |
| 4,065,040 | 12/1977 | Steere | 224/919 X |

*Primary Examiner*—Steven M. Pollard

[57] ABSTRACT

A ball holder comprising a single resilient ring having an internal diameter slightly less than the external diameter of the ball to be held and a clip means comprising a pair of substantially U-shaped members integrally joined at their top extremities to form a clip for engaging a planar substrate, said ring being attached to a center portion of the base of one of said substantially U-shaped members in a manner whereby said ring diverges outwardly from the point of attachment, the plane of said ring forming an acute angle with the plane of said substantially U-shaped member so as to permit insertion of a ball between said ring and said U-shaped member and to provide flexure of the ring away from said U-shaped member when a ball is inserted, the flexure of said ring providing sufficient biasing force to hold the ball between said ring and said U-shaped member.

8 Claims, 7 Drawing Figures

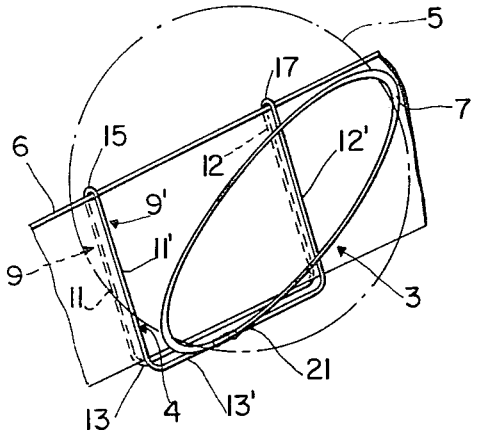
FIG. 1
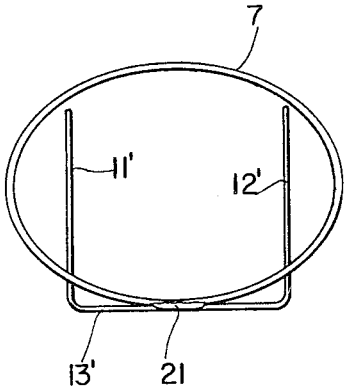
FIG. 2
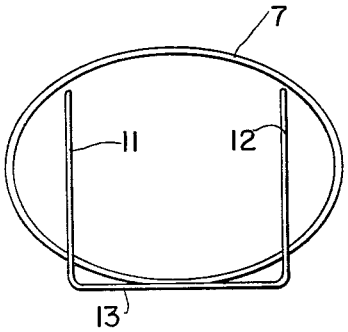
FIG. 3
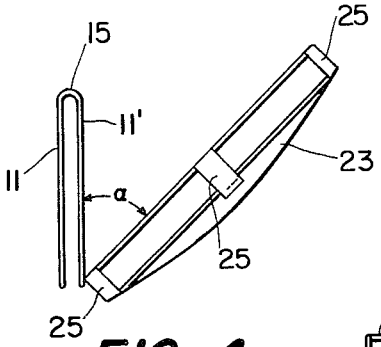
FIG. 4
FIG. 5
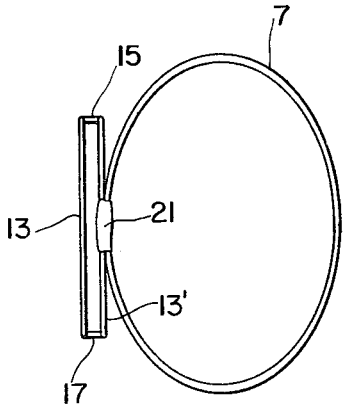
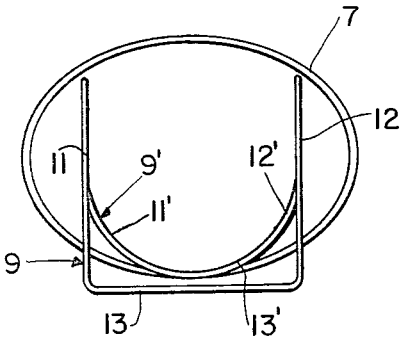
FIG. 6
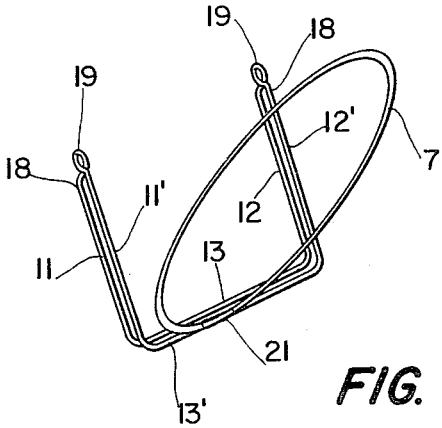
FIG. 7

CLIP-ON BALL HOLDER

BACKGROUND OF THE INVENTION

This invention relates to a ball holder and more particularly to a ball holder that can be comfortably worn by the player without obstruction.

There are many occasions in sport utilizing a ball wherein it is desireable to have the convenience of carrying on the person at least one additional ball. Perhaps the most common example of such a sport is the game of tennis where the server ordinarily is required to manage two balls. In general, the server carries both balls in one hand, puts one ball in a pocket, if available, or otherwise tucks the ball under a tight-fitting garment. All are unnecessary inconveniences.

The prior art has attempted with limited success to avoid or minimize these inconveniences. For example, U.S. Pat. No. 2,074,180 to F. J. Hatley discloses a belt-mountable tennis ball holder that includes a pair of resilient rings between which a tennis ball can be inserted and held. Unfortunately, the dual ring structure of the Hatley device results in a holder which when mounted onto the belt of the wearer protrudes too far out for most players and tends to obstruct or otherwise interfere with arm and body movement. In addition the gripping action of the clip portion of the Hatley ball holder is less than desireable tending to wiggle or sway during aggressive movement by the player.

Another dual ring-containing tennis ball holder is disclosed in U.S. Pat. No. 4,065,040 to Stephen D. Steere. Like the Hatley device, aforementioned, the Steere holder similarly protrudes outwardly an undue distance and has been criticized as being cumbersome and too obstructive in design. An additional shortcoming of the Steere holder is the fact that it requires the wearing of a belt and cannot be clasped onto modern tennis shorts that contain no belt.

Other tennis ball holders such as described in U.S. Pat. No. 2,708,061 to James Kotcha and U.S. Pat. No. 3,768,709 to William C. Kinard, in addition to protruding too far out, are much too heavy and/or bulky for comfortable play. Yet other known tennis ball holders suffer from the disadvantage of being engageable to tennis apparel only with considerable difficulty or requiring undue manipulation of elaborate clip features before engagement is secured.

Accordingly, it is an object of the invention to provide a ball holder substantially reduced in profile when mounted on the waist band or belt of the wearer which ball holder significantly lessens the tendency of the holder to obstract arm and body movement of the player during use.

Another object of the invention is to provide a light weight ball holder which can be worn on modern beltless tennis shorts as well as belted tennis apparel and whose presence is virtually undetected by the wearer during play.

Yet another object of the invention is to provide a ball holder of sturdy design which is characterized by extraordinary stability and gripping power or tension when clasped or clipped onto the waist band or belt of the wearer.

A further object of the invention is to provide an aesthetically-appealing ball holder which easily lends itself to adjustment so as to firmly engage a given substrate.

Quite another object of this invention is to provide a ball holder which in addition to the aforementioned objects enables easy insertion and removable of the ball therefrom.

SUMMARY OF THE INVENTION

These and other objects of the invention are obtained by a ball holder comprising a single resilient ring having an internal diameter slightly less than the external diameter of the ball to be held and a clip means comprising a pair of substantial U-shaped members integrally joined at their top extremities to form a clip for engaging a planar substrate, said ring being attached to a center portion of the base of one of said substantially U-shaped members in a manner whereby said ring diverges outwardly from the point of attachment, the plane of said ring forming an acute angle with the plane of said substantially U-shaped member so as to permit insertion of a ball between said ring and said U-shaped member and to provide flexure of the ring away from said U-shaped member when a ball is inserted, the flexure of said ring providing sufficient biasing force to hold the ball between said ring and said U-shaped member.

In a preferred form the ball holder is constructed or resilient wire.

DESCRIPTION OF THE DRAWINGS

The foregoing and other objects, advantages and features of the invention will be appreciated and better understood by reference to the following detailed description of presently preferred embodiments when considered in connection with the accompanying drawings wherein:

FIG. 1 is a perspective view of the ball holder mounted on a wearer's belt and holding a ball;

FIG. 2 is a front view of the ball holder;

FIG. 3 is a rear view of the ball holder;

FIG. 4 is a side view of the ball holder provided with a logo;

FIG. 5 is a bottom view of the ball holder;

FIG. 6 is an embodiment of the ball holder wherein one of the U-shaped members is more rounded at the base than the other U-shaped member; and FIG. 7 is an embodiment of the invention wherein the U-shaped members are provided with a coil at the juncture of their top extremities so as to increase the clasping force.

DETAILED DESCRIPTION OF THE INVENTION

Referring now to the drawings, and more particularly FIGS. 1–6, a ball holder 3 holding a tennis ball 5 is mounted to the waistband or belt 6 of a tennis player's shorts or dress. The ball holder 3 comprises a clip 4 and a ring 7. The clip is composed of two substantially U-shaped members indicated generally and 9 and 9', made of a high tensile, non-corroding wire of medium resiliency having a diameter of 0.04 cm. Each of the substantially U-shaped members have spaced apart legs 11-11'and 12-12' respectively, connected to bases 13, 13', respectively. Legs 11-11' and 12-12' of the U-shaped members are integrally joined at their top extremities 15 and 17, respectively, in any convenient manner. The clip may be readily formed, for instance, by simple folding over an integral piece of wire in rectangular form having sides corresponding to the total length of leg 11 plus leg 11' and leg 12 plus leg 12' in a manner that places the respective legs in parallel with each other. If desired the clasping force at the bases 13, 13' of the substantially U-shaped members can be increased by effecting the folding in a manner that forms an integral loop 18 (see FIG. 7) at the top extremeties and diverts the legs inwardly. With this embodiment of the invention the distance between legs 11 and 11' and legs 12 and 12' narrows progressively from top to bottom. Thus, as the thickness of the waistband or belt of the wearer increases or decreases, the clip 4 will provide optimum pressure at the base or bottom where it is most desired. Similarly, the clasp force of clip 4 can be increased by providing the substantially U-shaped members with a coil 19 at their junctures. (See FIG. 7).

By the term "substantially U-shaped" as used herein and in the appended claims is meant a shape which resembles or projects as a fundamental characteristic the form of the letter "U". Thus, one or both of the U-shaped members 9 and 9' can be essentially square, rounded or multi-sided at their base. In the preferred embodiment both U-shaped members of the pair have a square base. An alternative embodiment wherein the U-shaped member 9' is rounded and U-shaped member 9 is square is shown in FIG. 6. It is important, however, that the pair of substantially U-shaped members be parallel to each other so as to afford optimum retentive qualities throughout their entire length. Equally important is the width of the clip 4, that is, the distance between the legs of the U-shaped members. The width of the clip should be a distance sufficient to preclude or substantially eliminate movement of the clip once engaged onto the wearer's waistband or belt when the wearer is moving. In general the width of the clip will fall in the range of at least about ½, preferably about ¾ of the diameter of ring 7. A width in excess of the diameter of the ring is ordinarily unnecessary since no additional stability is gained. Too large a width also could create engagement difficulties due to the normal curvature of a waistband or belt. In the case of a ball holder for tennis balls, a clip having a width of approximately 4.7 cm has proved satisfactory.

The length of the legs of the U-shaped members can vary but are normally selected to fit comfortably over conventional waistbands or belts of tennis apparel. Ordinarily, the length of the legs falls within the range of 3.75 to 5 cm.

A ring 4, constructed of resilient wire similar to that of the clip 4, is attached as by welding to the base 13' of U-shaped member 9' at a center portion 21 thereof. The attachment is made in a manner whereby the ring 4 diverges outwardly from the point of attachment so that the plane of the ring 4 forms an acute angle with the plane of U-shaped member 9. The acute angle should be large enough to permit insertion of a ball between the ring 4 and U-shaped member 9' and provide a flexure that induces a sufficient biasing force to hold the ball therebetween. The optimum acute angle employed in any given instance will vary depending primarily upon the flexiibility of the ring used.

The internal diameter of the ring 4 will also vary depending upon the particular ball to be held but in all instances will be slightly less than the external diameter of the ball to held. In the case of a tennis ball, for example, a ring 4 having an internal diameter of approximately 6.2 cm has proved very satisfactory. For ease of insertion, the diameter of the ring preferably exceeds the length of the legs 11, 11' and 12, 12' of the U-shaped member so that when the ball holder is clipped onto the wearer's waistband or belt the edge of the ring is slightly higher than the top extremities of the U-shaped members. If desired, a circular plate 23, carrying a name or logo of say a tennis ball manufacturer, school, club, player or the like can be attached to the ring 4 by suitable suspending means such as canvas strips 25 placed around the ring 4. The plate 23 should be suspended a sufficient distance below the plane of ring 4 so as to accomodate the portion of the ball which will protrude through the ring upon insertion into the ball holder.

The ball holder of the invention can be covered if desired with a suitable protective coating so as to protect it against corrosion, wear and the like. Illustrative of suitable coatings are paint, plastics (both thermoplastic and thermosetting materials), synthetic and natural rubber coatings or covering, etc. Particularly preferred are resilient plastic coatings such as coatings of vinyl, polyester, polyethylene, polypropylene and the like. Additional adhesion might be achieved by selecting a tacky plastic or rubberized coating or covering for the clip.

While in the above description the ring has been described as a resilient wire, it should be understood that the ring can be composed of any solid flexible material such as metal, wood, plastic or the like having a diameter that affords resilience and outward flexure of the ring without exerting excessive dislodging pressures on the clip portion of the holder when the clip portion is engaged. Preferably the rings have a bending capability that enables adjustments as to shape. For instance, the use of bendable resilient rings enables the sides of a large ring to be bent by finger pressure alone into an oblong figure which would then accomodate and retain smaller balls such as handballs, racket balls and most balls of a dimension smaller than that of a tennis ball.

Likewise the clip portion of the ball holder can be of a material other than wire, e.g. metal, wood, plastic or alike as long as it is resilient and affords the desired waistband clasping or clipping function.

In use, the ball holder of the invention is merely clipped onto the waist belt or band of tennis apparel and is preferably attached to the back portion of such apparel so as to permit greater freedom or arm and body movement by the player. When the ball is placed in the holder, the holder, unlike prior art devices, actually grips the ball between the large outer ring and the apparel on which it is clasped thereby imparting a more snug or close-to-the-body effect. Thus the holder provides much less of a distracting feeling to the wearer.

Whereas the ball holder of the invention will perhaps find its greatest use with the belts or bands of tennis shorts and similar tennis apparel it can also be conveniently engaged to other substrates such as the brim of a hat, pant pockets, tennis socks, shirt sleeves and lapels and the like. Also, with respect to tennis ball holders manufactured in accordance with the present invention, the size of such holders is such as to conveniently fit into tennis ball cans for convenient storage.

Although exemplary embodiments of the invention have been disclosed for purposes of illustration, it will be understood that various changes, modifications, and substitutions may be incorporated in such embodiments without any parting from the spirit of the invention as defined by the claims appearing hereinafter.

It is claimed:

1. A ball holder comprising a single resilient ring having an internal diameter slightly less than the external diameter of the ball to be held and a clap means comprising a pair of substantially U-shaped members integrally joined at their top extremities to form a clip for engaging a planar substrate, said ring being attached to a center portion of the base of one of said substantially U-shaped members in a manner whereby said ring diverges outwardly from the point of attachment, the plane of said ring forming an acute angle with the plane of said substantially U-shaped member so as to permit insertion of a ball between said ring and said U-shaped member and to provide flexure of the ring away from said U-shaped member when a ball is inserted, the flexure of said ring providing sufficient biasing force to hold the ball between said ring and said U-shaped member.

2. A ball holder according to claim 1 wherein the substantially U-shaped members are comprised of resilient wire.

3. A ball holder according to claim 1 wherein the ball holder is provided with a protective plastic coating.

4. A ball holder according to claim 3 wherein the coating is a vinyl plastic.

5. A ball holder according to claim 3 wherein the coating is of a natural or synthetic rubberized material.

6. A ball holder according to claim 1 wherein the internal diameter of the ring is slightly less than tthe external diameter of a tennis ball.

7. A ball holder according to claim 1 wherein the pair of substantially U-shaped members form an integral loop at their top extremities and diverge inwardly to increase the clasping force at their bases.

8. A ball holder according to claim 1 wherein the pair of substantially U-shaped members are integrally joined together at their top extremities so as to include a coil for increasing the clasping force.

* * * * *